US005985096A

United States Patent [19]

Marcoccia et al.

[11] Patent Number: 5,985,096

[45] Date of Patent: Nov. 16, 1999

[54] VERTICAL PULPING DIGESTER HAVING SUBSTANTIALLY CONSTANT DIAMETER

[75] Inventors: Bruno S. Marcoccia, Queensbury, N.Y.; J. Robert Prough, Tarpon Springs, Fla.; Jerry R. Johanson, San Luis Obispo, Calif.; C. Bertil Stromberg, Glens Falls; Joseph R. Phillips, Queensbury, both of N.Y.

[73] Assignee: Ahlstrom Machinery Inc., Glens Falls, N.Y.

[21] Appl. No.: 08/936,047

[22] Filed: Sep. 23, 1997

[51] Int. Cl.[6] ..... D21C 7/00

[52] U.S. Cl. ..... 162/39; 162/52; 162/246; 162/251; 210/422; 220/661; 220/669; 422/239; 422/292

[58] Field of Search ..... 162/39, 55, 52, 162/251, 17, 246; 210/422; 220/661, 669, DIG. 13; 422/239, 292; 222/189.09, 564

[56] References Cited

U.S. PATENT DOCUMENTS

| | | | |
|---|---|---|---|
| 2,459,180 | 1/1949 | Richter | 214/17 |
| 2,695,232 | 11/1954 | Richter | 92/7 |
| 2,803,540 | 8/1957 | Durant et al. | 92/7 |
| 2,858,211 | 10/1958 | Durant et al. | 92/7 |
| 2,938,824 | 5/1960 | Richter | 162/42 |
| 3,007,839 | 11/1961 | Richter | 162/17 |
| 3,035,963 | 5/1962 | Schnyder | 162/19 |
| 3,041,232 | 6/1962 | Richter et al. | 162/17 |
| 3,097,987 | 7/1963 | Sloman | 162/17 |
| 3,200,032 | 8/1965 | Richter et al. | 162/19 |
| 3,243,341 | 3/1966 | Lang | 162/237 |
| 3,298,899 | 1/1967 | Laakso | 162/19 |
| 3,303,088 | 2/1967 | Gessner | 162/19 |
| 3,380,883 | 4/1968 | Richter et al. | 162/19 |
| 3,388,038 | 6/1968 | Ilander | 162/246 |
| 3,413,189 | 11/1968 | Backlund | 162/29 |
| 3,425,898 | 2/1969 | Laakso | 162/19 |
| 3,427,218 | 2/1969 | Richter | 162/19 |
| 3,429,773 | 2/1969 | Richter | 162/19 |
| 3,445,328 | 5/1969 | Laakso | 162/19 |
| 3,532,594 | 10/1970 | Richter | 162/19 |
| 3,579,418 | 5/1971 | Ostberg | 162/18 |
| 3,579,421 | 5/1971 | Richter | 162/237 |
| 3,711,367 | 1/1973 | Christenson | 162/251 |
| 3,802,956 | 4/1974 | Backlund | 162/19 |
| 3,811,994 | 5/1974 | Ostberg | 162/19 |
| 4,028,171 | 6/1977 | Richter | 162/17 |
| 4,057,461 | 11/1977 | Richter | 162/19 |
| 4,092,212 | 5/1978 | Richter et al. | 162/19 |
| 4,146,422 | 3/1979 | Prough | 162/49 |
| 4,174,997 | 11/1979 | Richter | 162/37 |
| 4,547,264 | 10/1985 | Sherman et al. | 162/19 |
| 4,670,098 | 6/1987 | Thorsell et al. | 162/29 |
| 4,958,741 | 9/1990 | Johanson | 220/83 |
| 5,069,752 | 12/1991 | Richter | 162/37 |
| 5,346,591 | 9/1994 | Henricson | 162/249 |
| 5,470,437 | 11/1995 | Oulie et al. | 162/237 |
| 5,489,363 | 2/1996 | Marcoccia et al. | 162/17 |
| 5,500,083 | 3/1996 | Johanson | 162/17 |
| 5,536,366 | 7/1996 | Marcoccia et al. | 162/43 |
| 5,547,012 | 8/1996 | Marcoccia et al. | 162/42 |
| 5,575,890 | 11/1996 | Prough et al. | 162/34 |
| 5,578,554 | 11/1996 | Richter | 162/237 |
| 5,617,975 | 4/1997 | Johanson et al. | 222/185.1 |
| 5,628,873 | 5/1997 | Johanson et al. | 162/17 |
| 5,635,026 | 6/1997 | Kettunen et al. | 162/19 |

*Primary Examiner*—Dean T. Nguyen
*Attorney, Agent, or Firm*—Nixon & Vanderhye P.C.

[57] ABSTRACT

In a vertical digester for producing chemical pulp, or other vessel for treating a slurry of comminuted fibrous cellulosic material, the cost of manufacturing the shell is significantly reduced by eliminating the external step increases in the digester shell. The digester shell has a substantially constant internal diameter from just below the inlet to just above the outlet, screen assemblies being provided by an internal transition (e.g. conical) having an angle of convergence of less than 40° (e.g. about 10–25°) above each screen assembly so that the slurry flows through the transition without bridging or hang-up, and a step increase, or other increase, in diameter back to the first diameter after the screen assembly.

22 Claims, 12 Drawing Sheets

40'
116'
47
46
50
113
52
52
θ
135
53
53
45
118
51
48
49
43
134
HEATER
54
116
132
120
133
41
40
122
131
126
46
42
127

VERTICAL PULPING DIGESTER HAVING SUBSTANTIALLY CONSTANT DIAMETER

BACKGROUND AND SUMMARY OF THE INVENTION

In the art of chemical pulping of comminuted cellulosic fibrous material, for example wood chips, the material is typically treated with cooking chemicals under pressure and temperature in one or more cylindrical vessels, known as digesters. This treatment can be performed continuously or in a batch mode. In the continuous mode, chips are continuously fed into one end of a continuous digester, treated, and continuously discharged from the other end. In the batch method, one or more batch digesters are filled with chips and cooking chemical, capped and then treatment commences. Once the treatment is finished the contents of the batch digester are discharged. In either batch or continuous digesters, a slurry of comminuted cellulosic fibrous material and cooking chemical moves through a cylindrical vessel.

In both continuous and batch digesters, in order to uniformly distribute both temperature and cooking chemical, cooking liquor is typically circulated through the slurry of chips and liquor, typically referred to as "the chip column". This circulation is typically effected by some form of screen, located along the internal surface of the cylindrical vessel, a pump, a heater, and a return conduit. The screen retains the material within the digester as the liquor is removed, augmented with other liquors and/or a portion thereof removed, pressurized, heated, and then returned to the slurry in the vicinity of the screen or elsewhere.

This radial removal of liquor typically produces radial compression of the chip column in the vicinity of the screen assembly. In addition, the weight of the column of chips above the chips near the screen introduces another source of compression of the chips. Furthermore, the vertical movement of free liquor in the chip column, either upward or downward, can vary the compression load, or compaction, of the chip column. It is known in the art that this radial and vertical compression can interfere with the uniform movement of the chip column, which is so essential for the uniform treatment of the chips. For this reason, conventional digesters and screen assemblies are designed so that the diameter of the flow path increases just below the screen. This increase in diameter or "step out" relieves the compression in the chip column and permits more uniform movement of the column. This step out typically consists of a radial increase of about 6 inches to 2 feet.

However, this increase in diameter of the vessel, requires that the diameter of the vessel shell include a step increase in diameter and also, typically, a conical transition in the shell to transition from the smaller diameter to the larger diameter. Both the non-uniform shell diameter and the additional welding necessary to accommodate the conical transition, among other things, can dramatically impact the cost of manufacturing a digester vessel. It would be highly advantageous to reduce the cost of manufacturing the shell of a digester by making such step increases in the digester shell unnecessary.

In addition, since the cylindrical column of chips typically does not conform to the increased diameter of the vessel, these step outs can provide an undesirable flow path for cooking liquor around the chip column, or can permit the chip column to collapse into the void created. This channeling of liquor can promote non-uniform treatment by causing non-uniform heating and non-uniform liquor distribution. The collapse or channeling of chips can also result in non-uniform treatment. Non-uniform treatment can be manifested in undercooking of chips (i.e., increased rejects), increased cooking chemical consumption, and reduced fiber strength, among other things. It thus also would be desirable to provide a method and apparatus for cooking comminuted cellulosic fibrous material so that channeling is minimized and uniform treatment of the chips enhanced.

In U.S. Pat. No. 4,958,741 a novel vessel geometry is disclosed for handling particulate material, for example, grain. U.S. Pat. Nos. 5,500,083; 5,617,975; and 5,628,873 disclose very effective methods and devices for applying the general techniques disclosed in the 4,958,741 patent to the handling and treatment of comminuted cellulosic fibrous material in the pulping industry. Specifically, U.S. Pat. Nos. 5,500,083, 5,617,975, and 5,628,873 disclose methods and systems for uniformly treating and discharging material from vessels without the aid of mechanical agitation. Typically, the disclosed vessels for handling comminuted cellulosic fibrous material, known, for example, as chip bins, have outlets that are smaller in cross sectional area than the main body of the vessels and use transitions having geometries exhibiting one-dimensional convergence and side relief. This technology is marketed under the name DIAMONDBACK® by Ahistrom Machinery Inc. of Glens Falls, N.Y.

As described in the U.S. Pat. No. 4,958,741 and elsewhere, the flow of particulate material through a vessel can be characterized as "mass flow" or "funnel flow". During mass flow, when any material is withdrawn from the vessel essentially all the material in the vessel moves. For funnel flow, when material is withdrawn, a portion of the material (generally in the center of the vessel) moves substantially faster than the material at the periphery. In the most severe cases, this flow pattern is referred to as "channeling" or "rat-holing". For right conical transitions or outlets, mass flow is ensured when the angle of convergence of the transition does not exceed a certain angle which is material dependent, known as the material's "critical mass-flow angle". Conical convergences having larger angles, that is, flatter cones, tend to produce non-uniform funnel flow. The critical mass-flow angle is typically determined experimentally using samples of the material that is to be passed through the vessel.

Of course, in the treatment of comminuted cellulosic fibrous material, mass flow is preferred. It is possible to prevent channeling and rat-holing by designing vessels with convergence angles less than or equal to the critical mass-flow angle for the material being transported. For wood chips in a chip bin, this angle is relatively shallow, for example, less than 30 degrees. Building a chip bin for a desired retention time but having such a shallow convergence to a desired outlet diameter requires that the bin be uneconomically tall. However, for the relatively small reductions in cross section required for a digester screen assembly, these shallow critical convergence angles can be used to simplify the construction and reduce the cost of digester vessels, without interfering with the stable function of the digester. In one embodiment of this invention, right conical transitions having angles of convergence less than the critical mass-flow angle are introduced to pulp digesters to aid in accommodating the use of screen assemblies in the digesters.

U.S. Pat. No. 4,958,741 introduces a geometry known as "one-dimensional convergence and side relief" which permits "mass flow" within vessels while exceeding the critical mass flow angle. By employing one-dimensional convergence geometry, reductions in vessel diameter can be achieved, while maintaining mass flow, that would require much longer transitions to achieve using a right conical transition. Typically, to avoid such undesirable transitions lengths, conical transitions are designed with angles greater than the critical mass flow angle but are agitated to prevent or minimize bridging or hang-up. In another embodiment of this invention, transtions exhibiting single-convergence and side relief are employed in pulping digesters to aid in accommodating the use of screen assemblies in the digesters.

Conical converging transitions are not unknown in the art of continuous cooking. With the advent of counter-current treatment in the late 1950s and early 1960s, conical converging transitions were often used to accommodate screen assemblies introduced to the bottom sections of existing continuous digesters. One example of such a transition is shown in U.S. Pat. No. 3,429,773 which was filed in 1965.

Prior to the introduction of treatments in the bottom of the digester, such as the use of cooling dilution to reduce the temperature of the pulp during discharge, that is, "cold blowing", or counter-current treatment, for example, counter-current Hi-Heat™ washing (see U.S. Pat. Nos. 3,007,839; 3,097,987; 3,200,032; and 3,298,899), continuous digesters did not have screen assemblies in their lower sections. See for example U.S. Pat. Nos. 2,474,862; 2,459,180; 2,938,824 and 3,041,232. Typically, after co-current treatment throughout the length of the digester, the completely cooked pulp was typically discharged, or "blown", from the bottom of these early digesters while still hot, that is "hot blowing". In order to introduce and distribute cool liquor or to effect counter-current treatment, some form of liquor distributing circulation with a screen assembly was introduced to the lower part of existing digesters. Furthermore, in order to minimize the cost of such a "retro-fit", these screen assemblies were introduced to the bottom sections of existing digesters with conical converging transitions, as shown U.S. Pat. No. 3,429,773. These conical convergences were solely introduced as a modification to existing structures. When such lower screens were and are used in newer digesters, in order to maintain the integrity and uniform movement of the chip column, some form of shell transition is used such that the internal surface of the screen is essentially flush with the internal diameter of the shell.

The conventional teaching in the art is that such conical convergences in any part of the digester, such as shown in U.S. Pat. No. 3,429,773, promote non-uniform movement or "hang-up" of the chip column and non-uniform treatment, and are to be avoided. Column movement was essentially ensured for screen assemblies located in the bottom of the digester, such as that shown in U.S. Pat. No. 3,429,773, by the presence of the rotating, discharge-aiding agitator, known as the "scraper", directly beneath the conical convergence. Any "bridging" that might develop due to the conical convergence above the screen was disrupted by the action of the scraper. This is also true of the conical convergence "collar" shown in U.S. Pat. No. 3,802,956. The present invention overcomes this misconception associated with convergences within the digester and provides a digester which is less expensive to manufacture. This invention also provides a means for introducing screen assemblies to existing vessels without requiring that the diameter of the vessel be enlarged at the location where the screen is introduced. This is especially true in locations where agitators are not present to aid in the movement of the chip column, for example, in cooking zones remote from the discharge of a digester.

Often, digester vessel schematics are drawn with uniform vessel diameters with representative screen assembly locations. For example, see U.S. Pat. Nos. 3,413,189; 3,445,328; and 3,427,218, or more recent U.S. Pat. Nos. 5,547,012; 5,489,363; 5,575,890; and 5,635,026. Clearly, these illustrations are schematic representations only and there is no intent to imply that actual vessels are built or can be built in this fashion, and would be understood as such by those of ordinary skill in the art. Those in the art understand that under present practice some form of chip column relief must be provided, otherwise the digester will not operate as desired.

Also, the prior art includes illustrations of digesters with uniform vessel diameters with screen assemblies having external cavities into which liquor is drawn. See for example U.S. Pat. Nos. 2,695,232 and 3,200,032. These illustrations depict digesters that do not provide the chip column relief that is so essential for proper chip column movement. Also, such constructions, as shown in U.S. Pat. No. 2,695,232, and U.S. Pat. No. 3,200,032 do not lend themselves to ease of design and manufacture since the external cavities are pressurized and their design must comply with pressure vessel design and manufacturing codes.

One embodiment of this invention takes advantage of the critical angle of convergence required for mass flow of a slurry of chips and cooking liquor to provide a digester having a uniform shell diameter while still providing the column relief that promotes the uniform movement of chips. According to one aspect of the present invention a digester [or other] vessel for cooking or treating comminuted cellulosic fibrous material in a liquid slurry [e.g. to produce cellulose pulp], the material having a critical angle of convergence, is provided. The vessel comprises: A substantially vertical vessel shell having a substantially constant first internal diameter. A first screen assembly mounted at an agitator-free location in said vessel and for removing liquid from the slurry, and including a second internal diameter smaller than the first internal diameter, and defining a screen cavity internal of the shell. A first transition above the first screen assembly between the first and second diameters, the first transition having an angle of convergence with respect to vertical. And, wherein the first transition angle of convergence is less than the critical angle of convergence of the liquid slurry cellulosic fibrous material, so that the slurry flows through the transition without bridging or hang-up, and without need for an agitator.

The vessel further comprises an increase in diameter to substantially the first internal diameter below the first screen assembly, the increase in diameter preferably being substantially immediately below the screen assembly and comprising a step increase.

The vessel also preferably further comprises a second screen assembly having a third diameter and disposed below the first screen assembly; and a second transition between the first diameter and the third diameter, the second transition having an angle of convergence less than the critical angle of convergence of the liquid slurry cellulosic fibrous material, so that the slurry flows through the transition without bridging or hang-up. The step increase in diameter is preferably provided to substantially the first internal diameter immediately below the second screen assembly.

As is conventional when the vessel is a digester (e.g. a continuous digester), the digester vessel also includes means for heating the liquid withdrawn from the first screen assembly and introducing the heated liquid adjacent the first screen assembly.

The first transition may include various geometries which permit the construction and use of vessels of uniform shell diameter. One preferred geometry comprises a substantially right conical transition, although other transition geometries (including those such as described in the patents mentioned above) may be provided. The first transition angle of convergence is less than 40°, and preferably less than 30° perhaps even less than 10°, depending upon flow characteristics. Typically the first transition angle is between about 10–25°, preferably between 10–20°. All of the transitions provided preferably are conical and with angles of convergence of less than 40°.

The conical transition may also provide a screening surface. That is, the conical section may not be smooth and continuous but it may also be perforated. For example, in order to aid in the removal of liquid from the chip column, the conical convergence may comprise a perforated screen plate or parallel-bar-type screens, or the like. In addition, the conical screening surface may comprise the only screening surface in the screen assembly. That is, no cylindrical screen surface may be present below the conical screen surface and the step increase to the first internal diameter may be located directly beneath the conical screening surface.

The increase in diameter below the screen assembly to the first internal diameter may also comprise a conical transition, in this case, a conical diverging transition. This diverging transition can minimize the formation of void spaces between the compressed chip column and the internal surface of the vessel and minimize column collapse and liquor channeling. This conical divergent transition may also be perforated. The removal of liquor via this lower conical screen transition can aid in drawing the compressed chip column out to the first internal diameter of the vessel.

The conical or cylindrical screening surfaces may be continuous in the circumferential direction or they may be interrupted by non-perforated blank plates. For example, if the screen assembly comprises two or more levels of screens, the screen surface and the blank plates may alternate such that the screen surfaces at one level may align with the blank plates of another (e.g. adjacent) level. This pattern is typically referred to as a "checker board" screen arrangement. Of course, a single row of screens may also include blank plates. The blank plates are typically uniformly distributed.

Also blank plates may also be located between one horizontal level of screens and another or between one horizontal level of screens and a transition. These blank plates are known as "relief plates". For example, in screen assembly comprising a first conical converging transition, a right cylindrical screen section, and a second conical divergent screen section below the right cylindrical screen section, a horizontal blank relief plate may be located between the right cylindrical screen surface and the second conical divergent screen surface. This horizontal "relief" permits the compressed chip column surface to "relax" or "recover" from being compressed by the liquor removal above before being drawn out by the liquor removal from the subsequent screen.

The first transition may also comprise or consist of a geometry known as "one dimensional-convergence geometry and side relief". As is clear from the descriptions provided in U.S. Pat. No. 5,500,083 and other patents. One dimensional convergence and side relief describes a configuration composed of two symmetrically oriented end surfaces that converge downward toward each other only in one dimension. Thus at any given cross-section, the surfaces will be reflections of each other around a horizontal center liner perpendicular to the singular direction of convergence. In its simplest form, the cross-section could be described by two parallel straight lines symmetrically oriented about a horizontal centerline also parallel to the two straight lines. Another cross-section form could be two semi-circles symmetrically oriented about a centerline parallel to the semi-circular axis. The general case of the cross-section would be any surface symmetrically reflected about a horizontal centerline. At any other level of cross-section, the surfaces would be similar in shape.

Side relief, as applied to the sides of the above-described surfaces, refers to the horizontal lines connecting the two closest end points of the surface. At any given cross-section, these lines are perpendicular to the centerline and hence parallel to each other. The relief comes about in that each succeeding lower pair of horizontal lines forming the sides are further apart or the same distance apart relative to the lines immediately above them. This produces divergence or non-convergence of the sides of the hopper.

Though in the earlier patents, transitions exhibiting single-convergence and side relief typically are mated to adjoining transitions exhibiting similar single-convergence and side relief, in one embodiment of this invention, only a single transition with this geometry is necessary. For example, in one embodiment of this invention, the transition between the first internal vessel diameter comprises or consists of two symmetric convergences to two opposing screen assemblies. These screen assemblies may be parallel to each other on either side of the vessel or they may appear as two opposing curved screening surfaces. The transition above the screens may comprise or consist of triangular-shaped planar sections that are representative of the Diamondback® Technology described in the above referenced patents, though other geometries can be used. As discussed above, the transition itself may comprise a screening surface in conjunction with or in lieu of a screening surface below it.

Another embodiment of this invention comprises or consists of a converging transition that is a single screen assembly which does not include a symmetric mating transition and screen, as described above. This embodiment also includes the option of using more than one of these single screen assemblies located at various elevations and at various orientations about the circumference and height of the vessel.

This invention also includes the use of mutiple single-convergence transisons as shown in U.S. Pat. Nos. 4,958,741 and 5,500,083, for example, to decrease the internal flow path of a digester to the diameter of a screen assembly. These transitions typically include two single-convergence transitions, but three or more transitions can also be used.

Another embodiment of this invention comprises or consists of one or more converging baffles having a screen assembly located beneath it. These baffles, or "eyebrows", may be triangular, semi-circular, or semi-ellipsoidal in shape and be oriented at any angle less than the critical mass flow angle for the material. The screen located beneath the baffle may be positioned vertically or may taper out to the internal diameter of the vessel. This embodiment also includes the option of using more than one of these baffles and screen assemblies. Multiple baffles and screens may be located at the same elevation and evenly (or unevenly) spaced around the internal circumference of the vessel shell, or they may be located at various elevations and orientations about the circumference and height of the vessel.

Another aspect of this invention comprises a method of introducing a screen assembly to an existing digester without requiring that the vessel diameter be increased, the digester having a substantially constant internal first diameter portion of a shell thereof at a location devoid of an agitator, using a screen assembly having a second internal diameter smaller than the first internal diameter, and a transition element providing a transition between the first and second diameters. The method comprising the steps of: (a) At the substantially constant internal first diameter portion of the shell of the existing digester that is devoid of an agitator, mounting the screen assembly to define a screen cavity internal of the shell, and a return to the first internal diameter below the screen assembly. (b) Forming at least one aperture in the shell adjacent the screen cavity and in fluid communication therewith to allow withdrawal of liquid in the screen cavity that has been separated by the screen assembly. And, (c) inserting the transition element within the shell, above the screen assembly, so that the transition element provides a transition between the first and second diameters that allows a slurry of comminuted cellulosic fibrous material to flow smoothly form above the transition element to below the screen assembly without bridging or hang-up and without need for an agitator. Step (a) may be practiced by providing the increase in diameter substantially immediately below the screen assembly, or by providing at least one of a diverging conical transition and a cylindrical relief plate below the screen assembly providing return to the first internal diameter.

The digester vessel preferably comprises a continuous digester (although the invention is also applicable to batch digesters) having a top and a bottom, with an inlet adjacent the top and an outlet adjacent the bottom, with the digester shell first diameter substantially constant from just below the inlet to just above the outlet.

According to another aspect of the invention an assembly, per se, for use in screening liquid is provided. The assembly comprises: a hollow substantially conical transition having an open top and an open bottom, a first diameter at the top and a second diameter at the bottom, the first diameter larger than the second diameter. An annular screen assembly for separating liquid from solid material, the screen assembly having a screen surface with a top, a bottom, and an internal diameter substantially equal to the second diameter, and the screen assembly having an external diameter substantially equal to the first diameter, and defining an annular volume exteriorly of the screen surface. The top of the screen surface operatively contacting the screen transition bottom so that the second diameters are positioned next to each other so that solids containing liquid may flow smoothly from the hollow transition into contact with the screen surface internal diameter. And, a hollow non-screen element operatively connected to the bottom of the screen surface and having an internal diameter substantially equal to the second diameter, and an external diameter substantially equal to the first diameter.

The screen surface may comprise a substantially continuous cylindrical screen surface, or have a wide variety of other configurations as is conventional for screen surfaces per se, particularly for screens in chemical pulp digesters. The hollow non-screen element preferably comprises a step transition, such as formed by the bottom of a header which supports the screen assembly and from which screened liquid is withdrawn. The conical transition has an angle of convergence to the vertical of less than 40°, preferably less than 30°, e.g. between about 10–25°,as described above.

According to another aspect of the present invention a method of treating a liquid slurry of comminuted cellulosic fibrous material under cooking conditions in a substantially vertical continuous digester having a top and a bottom and a first substantially constant (uniform) internal diameter, to produce chemical pulp, is provided. The method comprises the steps of substantially continuously: (a) Introducing the slurry of comminuted cellulosic fibrous material into the digester adjacent the top thereof, to flow downwardly in the digester in a flow path. (b) At at least one point along the digester which is devoid of an agitator, as the slurry moves downwardly in the flow path, causing the slurry of comminuted cellulosic fibrous material to transition from the first diameter of the flow path to a second flow path diameter smaller than the first diameter by at least about 2% [about 2–10%; e.g. for a 30-foot shell the step is about 6 inches, that is from 30 feet to 29 feet (6 inches) or a 3.33% reduction in diameter]. (c) Screening the slurry at the second diameter of the flow path to remove liquid therefrom. And, (d) removing the chemical pulp from adjacent the bottom of the digester.

The method also preferably comprises the further step (e), after step (c) and before step (d), of causing the downwardly moving slurry to move again to a substantially first diameter portion of the flow path. There is also preferably the further step of repeating steps (b), (c), and (e), at least once prior to step (d), and there is the further step of heating the liquid removed in the practice of step (c), and reintroducing the heated liquid into the digester adjacent where it was removed. As is conventional some of the liquid flow may be removed, and/or other liquid added, prior to return to the digester.

It is the primary object of the present invention to provide a simplified digester, having reduced costs of shell manufacture, while cooking comminuted cellulosic fibrous material so that channeling is minimized and uniform treatment of the chips enhanced. This and other objects of the invention will become clear from an inspection of the detailed description of the drawings and from the appended claims.

DETAILED DESCRIPTION OF THE DRAWINGS

Figure 1:
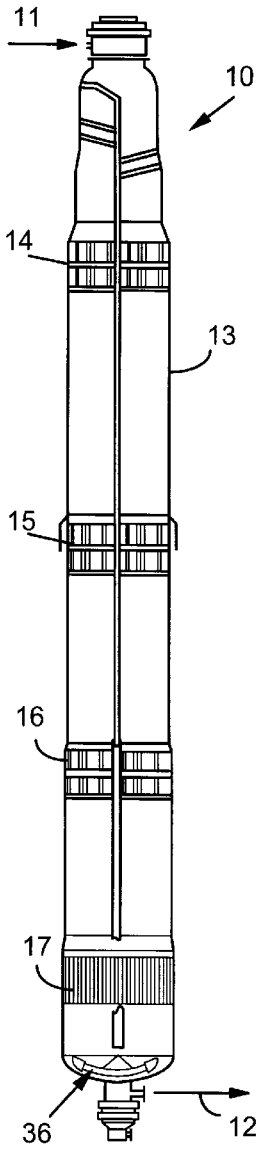
Fig. 1 (PRIOR ART)
FIG. 1 is a schematic side view of a prior art continuous digester having a shell with external step transitions at each screen assembly.

FIG. 1 illustrates a typical prior art continuous digester 10 exhibiting "step-outs" associated with each screen assembly. Though a vertical continuous digester is shown, it is to be understood that the present invention is applicable to any type of cylindrical digester, continuous or batch. A slurry of comminuted cellulosic fibrous material and cooking chemical is introduced at the top 11 of the digester and a slurry of fully-cooked pulp and spent cooking liquor is discharged at the bottom 12. The digester 10 comprises a cylindrical shell, 13, and numerous cylindrical screen assemblies 14, 15, 16 and 17. Digester 10 clearly illustrates the increase in shell diameter that occurs at each screen assembly to accommodate the chip column compression. Also associated with each screen assembly is a conical transition located above each screen assembly. The typical geometry of screen 16 is illustrated in more detail in FIG. 2.

Figure 2:
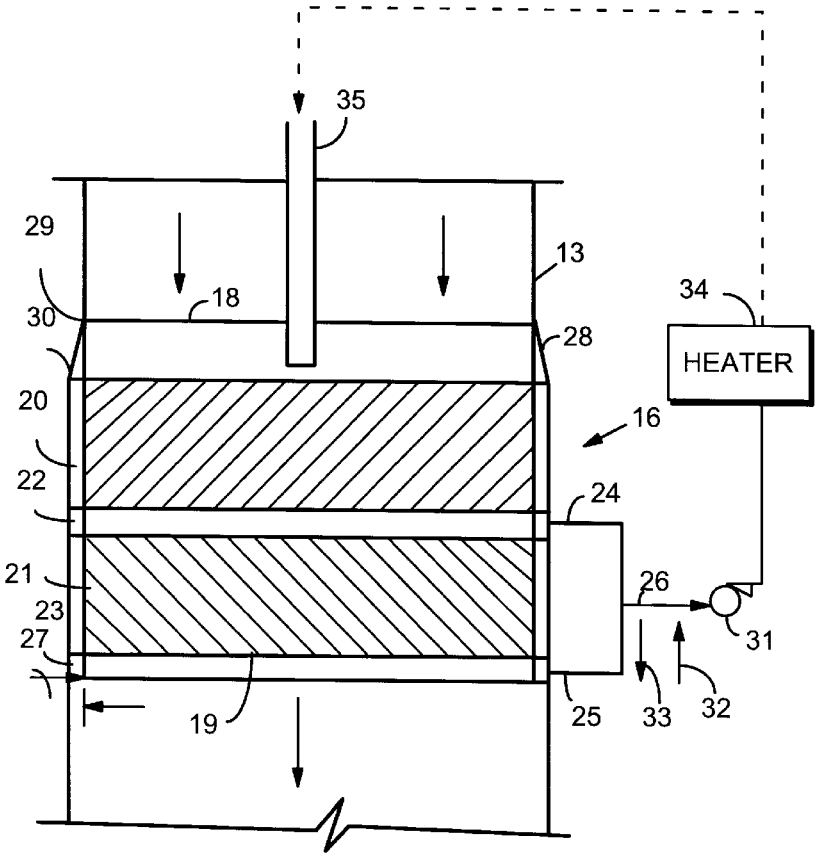
Fig. 2 (PRIOR ART)
FIG. 2 is a detail side cross-sectional view at one of the screen assemblies of the digester of FIG. 1.

FIG. 2 illustrates a typical prior art screen assembly having an upper screen 18 and a lower screen 19. These screens may be of various construction, such as perforated plate, for example, plates having circular holes or milled slots, or they may be constructed by means of parallel bars having parallel apertures between the bars. These slots or apertures may be positioned in various orientations such as vertically, horizontally, or any oblique angle; for example, they may be oriented at a 45-degree angle from the vertical.

Behind each screen 18, 19 typically is a annular cavity 20, 21, for collecting the liquid withdrawn through each screen 18, 19. Beneath each annular cavity 20, 21, are smaller annular cavities 22, 23, commonly referred to as "internal headers", for collecting the liquid from cavities 20, 21, and discharging it to liquor removal conduits 24, 25. Though these cavities are shown as being located internal to the shell 12, they may also be located external to the shell, that is, "external headers" may be used. Cavities 20, 21 and cavities 22, 23, typically communicate by means of apertures having specially-designed dimensions, that is, orifice holes, in order to promote uniform removal of liquid through each screen, as is conventional. Conduits 24, 25 typically join a single conduit 26 which communicates with a re-circulation pump 31.

Beneath each screen assembly 16 the diameter of the shell 13 is increased at step out 27. Again, this step-out helps to relieve the compressive forces formed in the chip column due to the vertical compression of the weight of the chips and the radial compression of the liquor removed through the screens. This radial increase may range from a 1 to 36 inches, but is typically between 6 and 24 inches, which may be an increase of about 2–10% of the diameter of shell 13. In order to accommodate this increase in shell diameter, some form of transition 28 must be used. The transition 28 is typically conical. The transition 28 not only increases the diameter of the vessel 13, but also introduces an additional juncture that must be secured to the larger shell diameter, typically by welding. Where a shell of uniform diameter may need at most a single welded connection 29, introducing the conical transition, requires a second welded joint 30. Note that since digesters 10 are pressurized, typically to 100 psig or more, the rolled plate from which the shell is made is typically ¾ to 2½ inches thick. In addition, such vessels must adhere to pressure vessel codes, not only in design but also in fabrication. The welds 29, 30 must be designed and welded to code. Therefore, any vessel design which limits the number of welded joints, significantly reduces he cost of manufacturing the vessel.

As is conventional, FIG. 2 illustrates the return system associated with an exemplary screen assembly 16. Some of the screen assemblies will have merely extraction, but typically two or more of the screen assemblies in the digester 10 have the pump 31 connected to the conduit 26 to withdraw liquid into the conduit 26, with potentially some liquor added as indicated schematically at 32 in FIG. 2, and/or some liquor withdrawn as indicated schematically at 33 in FIG. 2. The added liquid in 32 may be white liquor, or make-up liquor having lower dissolved organic material content than the withdrawn liquor in line 33, or it may have any other compositions known in the art.

From the pump 31 the liquid is pumped typically through a heater 34, and the heated liquid is reintroduced into the digester 10 using an internal conduit 35 so that the withdrawn liquor is returned near the area where it was removed (typically just above the screen 18). There are a wide variety of different conventional structures for this purpose.

After the pulp is formed it is washed, or subjected to more uniform heat or liquor distribution, at screen 17 and an agitator 36 (which is typically rotating arms, but may comprise almost any mechanical structure for breaking up compactions) helps discharge the pulp from the digester 10, as indicated at 12 in FIG. 1.

Figure 3:
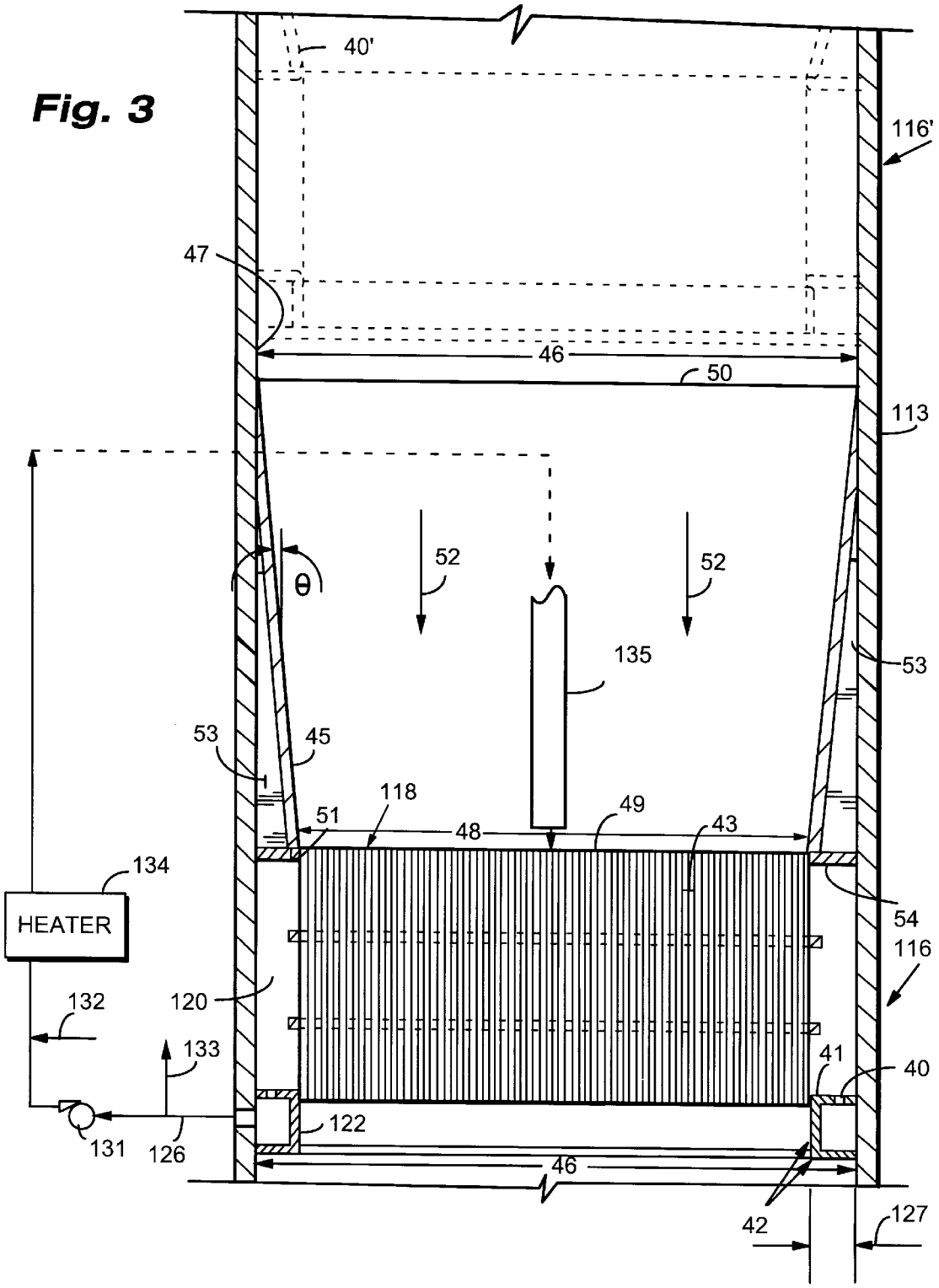
FIG. 3 is a view like that of FIG. 2 only for a digester according to the invention.

FIG. 3 illustrates a typical digester screen assembly according to the present invention. Several of the features shown in FIG. 3 are similar or identical to those shown in FIGS. 1 and 2; these features are distinguished from the earlier ones by the prefixed numeral "1".

Shell 113 contains a screen assembly 116. This screen assembly 116 is shown as a single screen 118, but it is to be understood that the screen assembly 116 may comprise or consist of one, two, or multiple screens (e.g. two screens as shown in FIGS. 1 and 2). Screen 118 is a conventional screen of one or more of the various types of constructions as described for screens 18, 19 above. Screen assembly 116 typically includes an annular cavity 120 internal of the shell 113, and an internal header 122 which discharges to conduit 124, as is conventional. Cavities 120, 122 typically communicate via multiple orifices, 40 in the top plate 41 of the header 42 defining the annular cavity 122. As in FIGS. 1 and 2, the column compaction is relieved by introducing a diameter step increase 127 below the screen 118.

Though the screen 118 is shown as having a continuous cylindrical screen surface, 43, it is to be understood that the screen surface 43 may not be continuous or cylindrical. For example, the screen surface 43 may also comprise multiple individual circular screens, or the screen assembly comprises alternating screen surfaces and blank plates, commonly referred to as a "checker board pattern".

The most distinguishing feature of the invention shown in FIG. 3 is the hollow transition 45. This transition 45 reduces the internal diameter of the flow path from essentially the first internal diameter 46 of the internal surface 47 of the shell 113 to the second internal diameter 48 of the top 49 of the screen assembly 118. The transition 45 is preferably conical (e.g. right conical transition) having a top 50 substantially with diameter 46, and a bottom 51 aligned with the top 49 of screen 118, for smooth flow of slurry through transition 45 to inside the screen 118. While the transition 45 is preferably substantially conical for ease of construction, it can have more complicated geometries, such as shown for the transitions in U.S. Pat. Nos. 4,958,741, 5,500,083, 5,617,575, and 5,628,873.

The transition 45 may be supported by a plurality of trapezoidal or triangular support plates 53 disposed between the outer surface of the transition 45 and the inner wall 47 of the shell 113. The plates 53 may in turn be supported by the annular substantially horizontal support 54, which is substantially aligned with the top 49 of screen 118. Though plates 53 are shown positioned longitudinally, circumferential support plates may also or alternatively be used. The transition 45 preferably has an angle of convergence to the vertical, shown as θ in FIG. 3, that is less than or equal to the critical mass-flow angle of convergence of the slurry of comminuted cellulosic fibrous material passing through the transition. This angle is typically less than 40°, and preferably less than 30°, and may be even less than 10° depending upon flow characteristics. Typically the angle is between about 10–25°, preferably between 10–20°. Thus the slurry flowing in direction 52 passes through a region of reduced diameter without interfering with the uniform flow through the vessel. However, by using such a transition, the diameter of the shell may be maintained constant through out the transition, thus reducing the cost of manufacturing the vessel.

After the header 42 the flow path of the slurry returns to substantially the diameter 46. This is preferably accomplished by the step increase 127 seen in FIG. 3.

In lieu of a step increase in diameter 127, the increase in shell 113 diameter below the screen 118 may be effected by means of another transition, for example, a conical transition, located beneath the screen 118 to gradually increase the diameter of the flow path to the internal diameter 46 of the vessel shell 113. Other transitions of other geometries also may be used as long as the effective diameter returns to substantially the internal diameter 46 of the shell 113.

Figure 4:
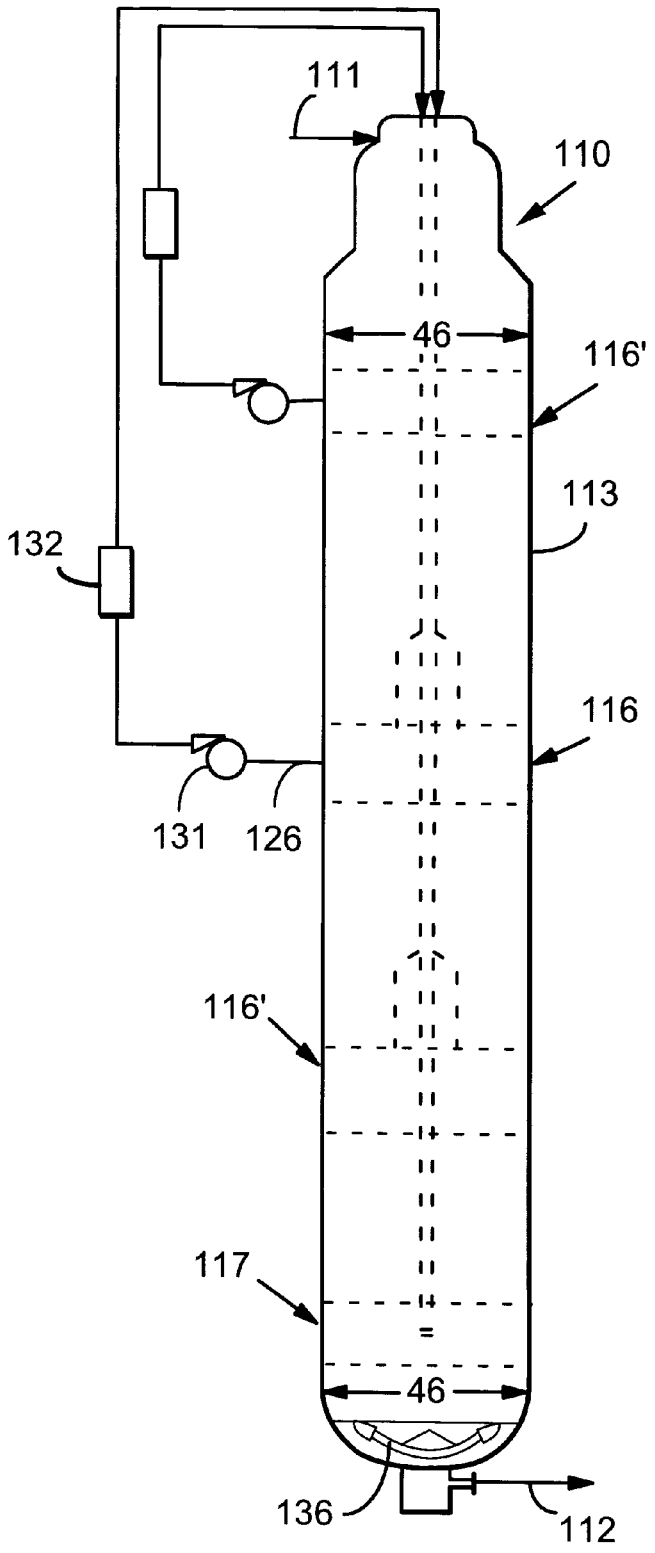
FIG. 4 is a view like that of FIG. 1 only for a continuous digester according to the invention.

More than one such screen and transition can be—and almost always is—used in the same vessel 113 as shown in phantom by screen assembly 116' and transition 50' above screen assembly 116. The screen assemblies 116, 116' are normally more widely spaced as seen in FIG. 4. FIG. 4 shows an exemplary continuous digester according to the invention having slurry introduction 111 adjacent the top, and slurry (chemical pulp) withdrawal 112 adjacent the bottom. The digester shell 113 first diameter 46 is substantially constant from just below the inlet 111 to just above the outlet 112, as indicated by the two reference numerals 46 in FIG. 4. A wash circulation screen assembly 117 (which may have the construction of screens 116') is provided adjacent the outlet 112, just above conventional agitator 136 (of any type). The assemblies 116, 116' are positioned in digester 110 at locations free (devoid) of an agitator since no agitator is necessary to release compaction or destroy "bridges". The positioning of an agitator in the vicinity of these screens is not only physically difficult but also undesirable since it is preferable to maintain the integrity of the chip column near these screens to promote uniform treatment, for example, during cooking.

The invention, in addition to comprising the digester 110 with the screen assemblies 116, 116', also comprises assemblies per se for use in screening liquid, such as shown by the transition 45 , screen surface 43, and supporting header 42 as illustrated in FIG. 3. The components 45, 53, 54, 42, may be welded or otherwise attached together, but there is no requirement for the additional high quality welds like the welds 29, 30 in the shell 13 of a conventional prior art digester 10. In addition, the conical shell transition piece, 28, is no longer necessary. Also the components 53, 45, 54, 42 may be welded or otherwise affixed to the inner surface 47 of the shell 113, but again the additional welds like the welds 29, 30 are not necessary, and connection of the screen assembly 116 and associated components is typically no more difficult or different than for the screen assemblies 16 of the prior art digester 10. The present invention provides for the fabrication of cylindrical digesters from cylindrical sections, known as "cans", having essentially uniform diameter.

Utilizing the digester 110 with a substantially constant internal diameter 46 it is possible to produce chemical pulp by treating a liquid slurry of comminuted cellulosic fibrous material (such as wood chips, bagasse, or the like) under cooking conditions. In the vertical digester 110 the method comprises the steps of substantially continuously: (a) Introducing the slurry of comminuted cellulosic fibrous material into the digester 110 adjacent the top thereof (as indicated at 111 in FIG. 4) to flow downwardly in the digester 110 in a flow path. (b) At at least one point along the digester 110, which is devoid of an agitator, as the slurry moves downwardly in the flow path, causing the slurry of comminuted cellulosic fibrous material to transition from the first diameter 46 of the flow path to a second flow path diameter 48 smaller than the first diameter 46 by at least about 2% (e.g. about 2–10%). This transitioning is typically provided by the substantially conical transition element 45 having the angle of convergence θ that is preferably less than 30°. (c) Screening (using the screen surface 43) the slurry at the second diameter 48 of the flow path to remove liquid therefrom (in line 126 after the liquid is passed into annular chamber 120 and interior 122 of header 42). And (d) removing the chemical pulp from adjacent the bottom of the digester, as indicated at 112 in FIG. 4, e.g. including by using the conventional agitator 136 after screen assembly 117. There is typically the further step (e), after step (c) but before (d), of causing the downwardly moving slurry to move again to a substantially first diameter portion 46 of the flow path, as indicated by the step transition 127 in FIG. 3. The method also preferably comprises the further steps of repeating steps (b), (c), and (e) at least once prior to step (d) (see the screen assemblies 116 and 116' in FIG. 4 for example), and of heating the liquid removed (in heater 134) and reintroducing the heated liquid (with optional augmentation at 132 and/or withdraw at 133) into the digester 110 adjacent where it was removed (as indicated by internal central conduit 135 in FIG. 3).

Instead of the embodiment illustrated in FIG. 3, a wide variety of other embodiments of screen assemblies that do not require an increase in diameter of the vessel (such as a digester) in which they are disposed, may be provided, and are shown in FIGS. 5–18.

Figure 5:
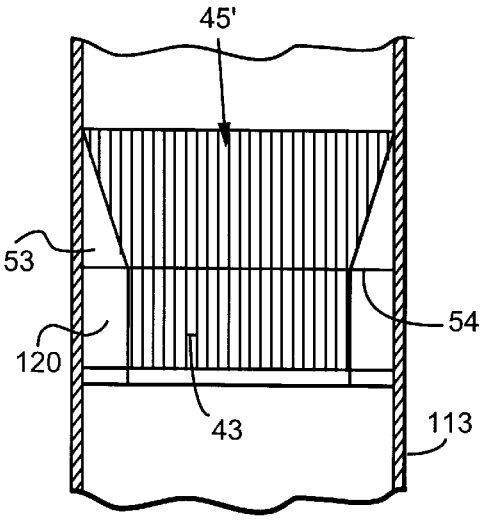
FIGS. 5, 6, and 7A are schematic side cross-sectional views showing various other embodiments of screen assemblies and transitions in the digester vessel according to the present invention.

In FIG. 5 the same reference numerals are used as in FIG. 3 except for the transition. The transition 45' is a right circular cone like the transition 45 only it includes at least one screen section. In FIG. 5 the transition 45' is shown as a continuous screen, and the cavity behind the screen transition 45' adjacent the plates 53 communicates with the cavity 120 behind the screen 43, such as by providing a plurality of openings (not shown) in horizontal support 54. FIG. 5 (and FIGS. 6 through 18), for simplicity of illustration, does not show any header details, or any recirculation or reintroduction structures for liquid withdrawn through the screens 43, 45'.

Figure 6:
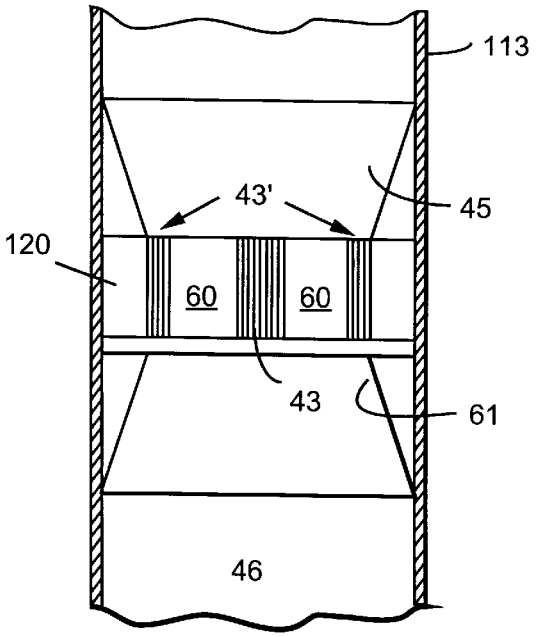

In FIG. 6 the same reference numerals are used as in FIG. 3 except for structures that differ from those in FIG. 3. In the FIG. 6 embodiment the screen 43' is shown as discontinuous, rather than continuous, including alternating screen sections and blank plates 60. Also, instead of providing a step increase in diameter immediately below the screen assembly 43' a diverging conical transition 61 is provided so that the increase in diameter back to the first diameter 46 is spaced from the screen assembly 43'. The diverging conical transition 61 may be connected to the shell 113 in the same way that the converging transition 45 is.

Figure 7A:
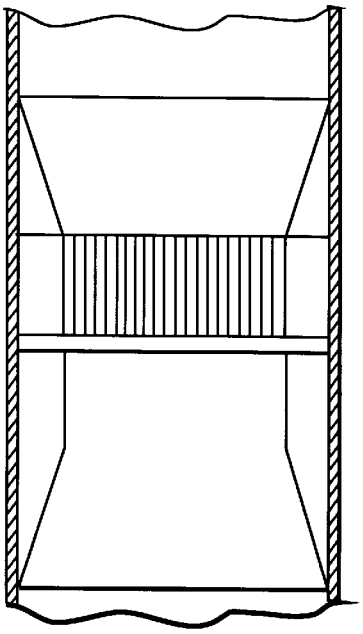

In FIG. 7A the same reference numerals are used as in FIG. 3, except for added structures. In this embodiment a cylindrical relief plate 62 is provided beneath the screen assembly 43 for spacing the return to the first diameter 46 of the shell 113 from the screen assembly 43. Also in this embodiment a diverging conical transition 63 is provided, like the transition 61 in FIG. 6 except that it has alternating screen sections 64 with blank plates 65.

Figure 7B:
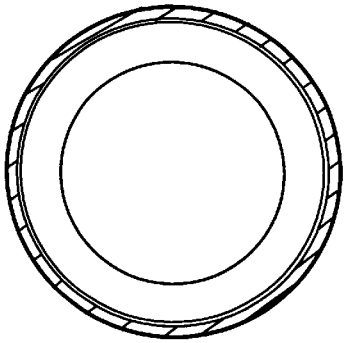
FIG. 7B is a schematic cross-sectional view taken along lines 7B—7B of FIG. 7A.

FIG. 7B is a schematic longitudinal cross-sectional view taken along lines 7B—7B of FIG. 7A. Note that FIG. 7B is the same as the longitudinal cross-sectional views of FIGS. 3 and 6 would be, and similar to that of FIG. 5 (except that in FIG. 5 one would see the screen features of the transition 45').

FIGS. 8 through 11 are schematic views like those of FIGS. 3 and 5 through 7B, except in these embodiments the transition is different. To the extent that structures are the same as those in FIG. 3 the same reference numeral is used.

Figure 8:
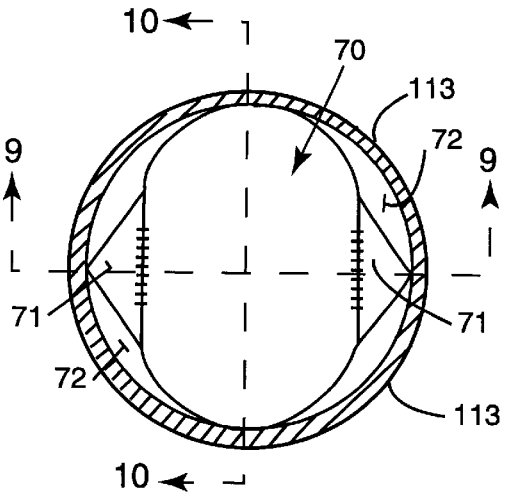
FIG. 8 is a longitudinal schematic cross-sectional view of a digester vessel according to another embodiment of the present invention which includes a multiple single symmetric one dimensional convergence transition.
Figure 9:
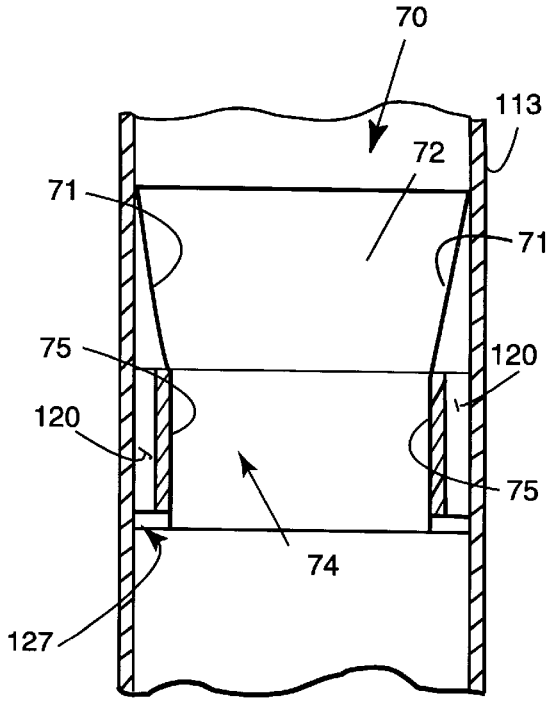
FIGS. 9 and 10 are schematic cross-sectional views of the embodiment of FIG. 8 taken along lines 9—9 and 10—10 thereof, respectively.
Figure 10:
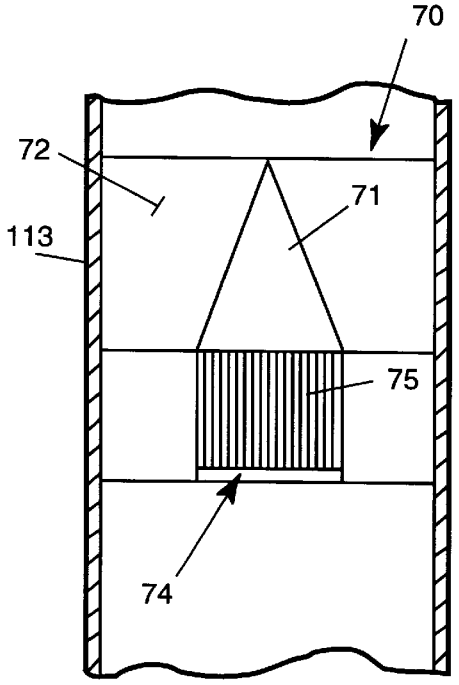

In the embodiment of FIGS. 8 through 10 the transition 70 comprises a multiple single symmetric one dimensional convergence transition, using principles from U.S. Pat. Nos. 4,985,741 and 5,628,873. The transition 70 includes a pair of triangular panels 71 with contoured connecting surfaces between them. The screen assembly, shown schematically generally at 74 in FIGS. 9 and 10, disposed substantially immediately below the transition 70, includes a screen section 75 (see FIGS. 9 and 10) at least substantially immediately below each of the panels 71. The screen section 75 may be straight, as illustrated in FIGS. 9 and 10, or may be curved, and they may be wider than is illustrated in FIGS. 9 and 10, but not necessarily narrower.

Note that the transition 70 has a complex angle of convergence, but the angle of convergence thereof is less than the critical angle of convergence of the liquid slurry and the cellulosic fibrous material that flows downwardly in the vessel shell 113. A complex angle of convergence includes a straight converging surface which transitions to a curving, converging surface; the angles of FIGS. 8–14 are complex, while the angles of FIGS. 15–18 are simply straight sections that have angles less than or equal to the critical mass-flow angle for the slurry. Each of these surfaces can have an angle of convergence greater than the critical angle of convergence of the liquid slurry and the cellulosic fibrous material will still flow downwardly in the vessel shell 113.

Figure 11:
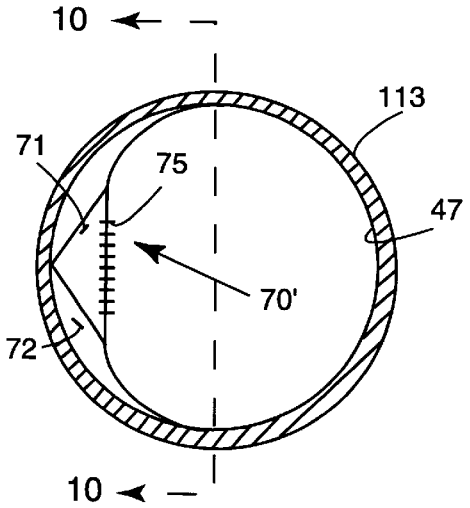
FIG. 11 is a view like that of FIG. 8 of a single non-symmetric one dimensional convergence transition.

FIG. 11 shows an embodiment like that of FIGS. 8 and 9 only the first transition 70' comprises a single non-symmetric one dimensional convergence transition including a singular triangular plate 71 with a screen section 75 (see FIG. 10 which is common to both the FIGS. 8 and 11 embodiments) immediately below. In this case the contoured surface 72 of the transition 70' terminates at or just before the sectional lines 10—10, which bisect the diameter of the shell 113, so that merely the inside surface 47 of the shell 113 is opposite the screen section 75.

Figure 12:
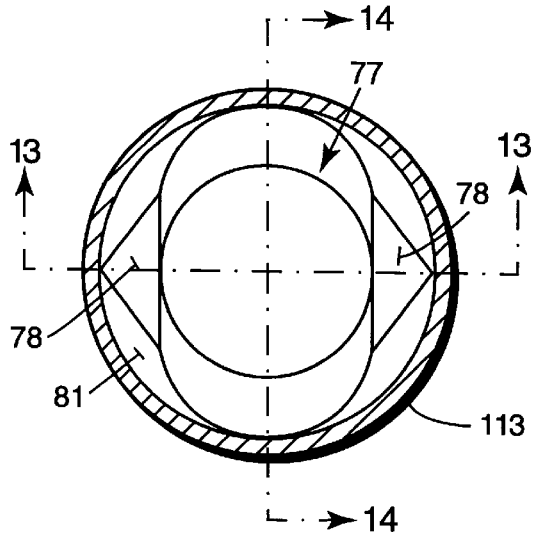
FIG. 12 is a view like that of FIG. 11 for an embodiment according to the invention containing multiple one dimensional convergence transition elements.
Figure 13:
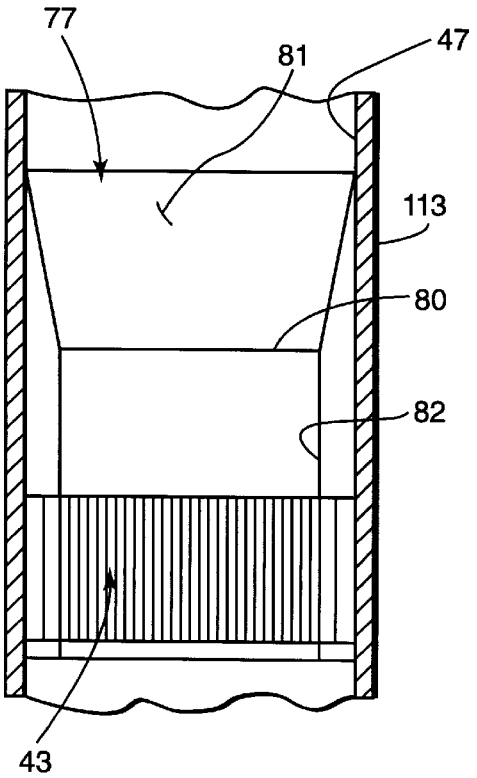
FIGS. 13 and 14 are cross-sectional views of the embodiment of FIG. 12 taken along lines 13—13 and 14—14 thereof.
Figure 14:
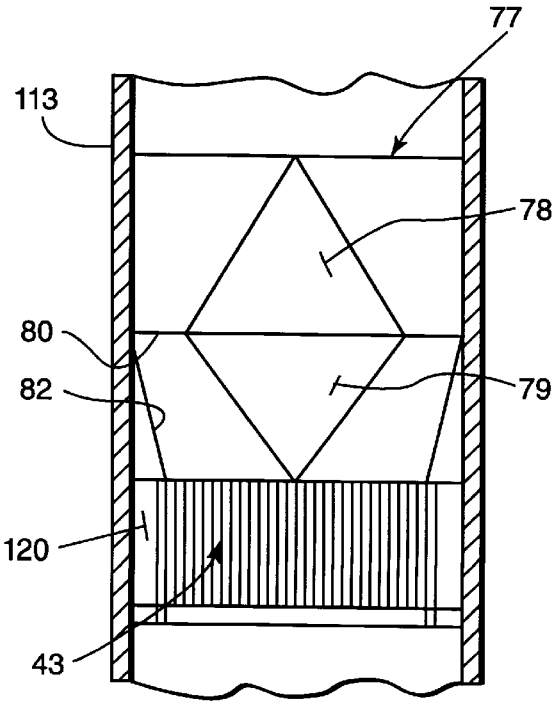

In the embodiments of FIGS. 12 through 14 reference numerals that are the same as for the FIG. 3 embodiment are used to the extent that the structures are the same. In this embodiment the transition 77 comprises multiple one dimensional convergence transition elements. That is the convergent elements are like those in the DIAMOND-BACK® chip bin sold by Ahlstrom Machinery Inc. of Glens Falls, N.Y. and as shown in U.S. Pat. Nos. 4,958,741 and 5,628,873. In this case dual triangular panel sets 78, 79 are provided on opposite portions of an intermediate demarcation 80 of the transition, with a complex tapered surface 81 above the demarcation 80, and another one 82 below the demarcation 80.

In all of the embodiments of FIGS. 8 through 14 the complex geometries, and complex angle of convergence thereof, facilitate smooth flow of the cellulosic fibrous material downwardly in the shell 113 without hang-up or bridging, and without the need for an agitator.

FIGS. 15 through 18 show yet another embodiment of the transition and screen assembly components of the apparatus according to the invention.

Figure 15:
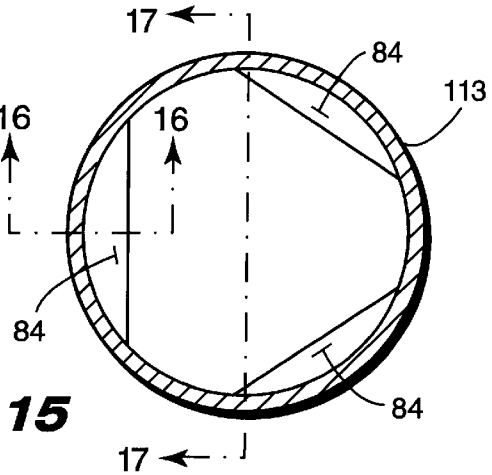
FIG. 15 is a view like that of FIG. 12 for an embodiment according to the invention which comprises a plurality of eyebrow baffles as the transition.
Figure 17B:
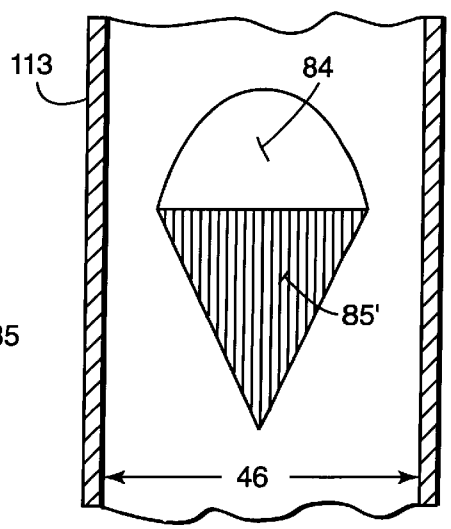
FIGS. 17A and 17B are views like those of FIGS. 16A and 16B only taken along lines 17—17 of FIG. 15.
Figure 17A:
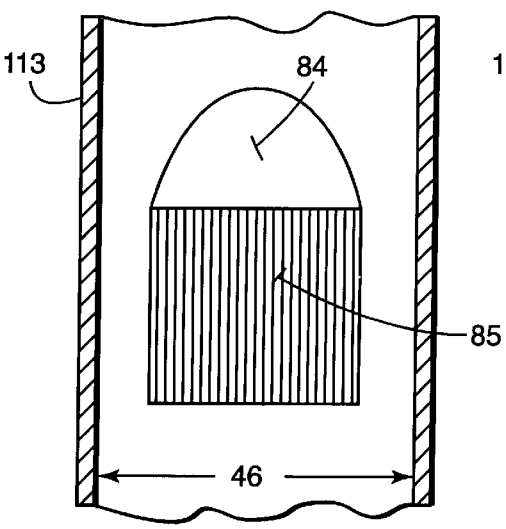
Figure 16B:
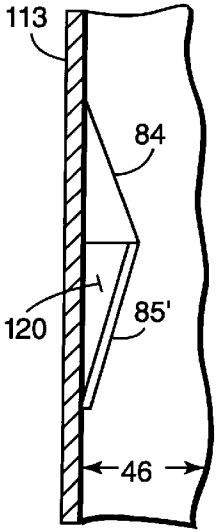
FIGS. 16A and 16B are schematic cross-sectional views of two alternative modifications of the embodiment of FIG. 15 taken along lines 16—16 thereof.
Figure 16A:
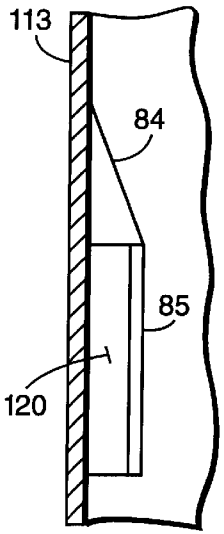

In FIG. 15, the transition comprises a plurality of eyebrow baffles 84. A screen section 85 (the embodiment of FIGS. 17A and 17B) and at 85' (the embodiment of FIGS. 16B, 17B) is provided substantially immediately below each of the eyebrow baffles 84. The baffles 84 are called eyebrow baffles because they have a configuration generally like an eyebrow or eyelid including a curvature which is apparent from FIGS. 17A and 17B. The only difference between the screen sections 85, 85' is that the screen sections 85 have the screen surface thereof extending substantially parallel to the shell 113, while the screen sections 85' taper downwardly back to the first diameter 46. The relative dimensions of the eyebrow baffles 84 and screen sections 85, 85' may be increased or decreased compared to those schematically illustrated in FIGS. 15 through 17. All of the screen sections 85, 85' associated with the plurality of eyebrow baffles 84 at any one location along the shell 113 form a screen assembly.

Figure 18:
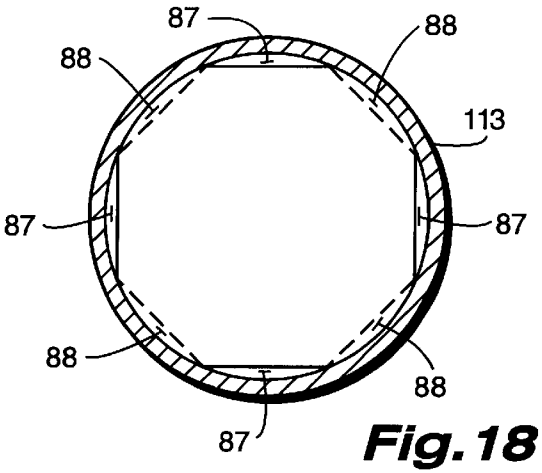
FIG. 18 is a view like that of FIG. 15 only for an embodiment showing multiple eyebrow baffles at different elevations.

FIG. 18 schematically illustrates an embodiment in which one set of four eyebrow baffles 87, and associated sections, are located at one elevation of the shell 113, and a second set, shown in dotted line and schematically at 88, at a different elevation. The eyebrow baffles 84, 87, 88 may be positioned at different elevations and they have no particular orientation with respect to each other. The configuration of the eyebrow baffles 84, 87, 88 also has a complex angle of convergence so that the slurry of comminuted cellulosic material may flow downwardly within the shell 113 without hang-up or bridging, and without the need for an agitator.

FIGS. 19–22 illustrate typical preferred embodiments of this invention. For illustrative purposes, the embodiments depicted in FIGS. 3, and 5 through 18 illustrate schematic representations of the various embodiments which are included in this invention. For example, an illustration having only a 2% decrease in diameter would make it difficult to illustrate the fine distinctions between one embodiment and another. The embodiments shown in FIGS. 19–22 better illustrate how an actual to-scale screen assembly according to the embodiment shown in FIGS. 12–14 would appear.

First note that, in contrast to the earlier illustrations, the approximately 2% decrease in diameter is less pronounced in these figures. Second, the triangular shaped panels, 178, 179, are markedly shorter in length and narrower in width than those shown schematically earlier.

Figure 19:
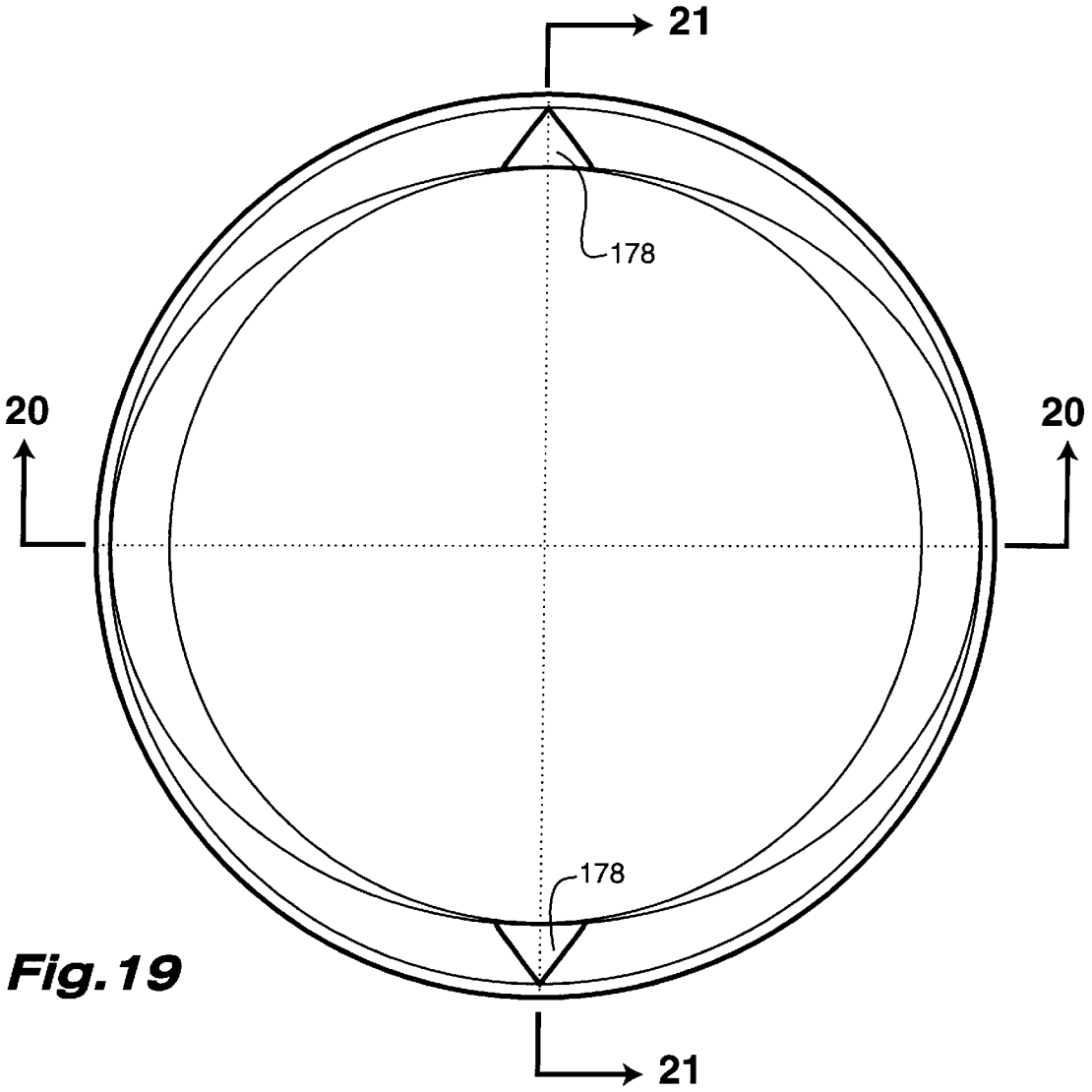
FIG. 19 is a top cross-sectional view of the interior of another digester configuration using features according to the invention.
Figure 20:
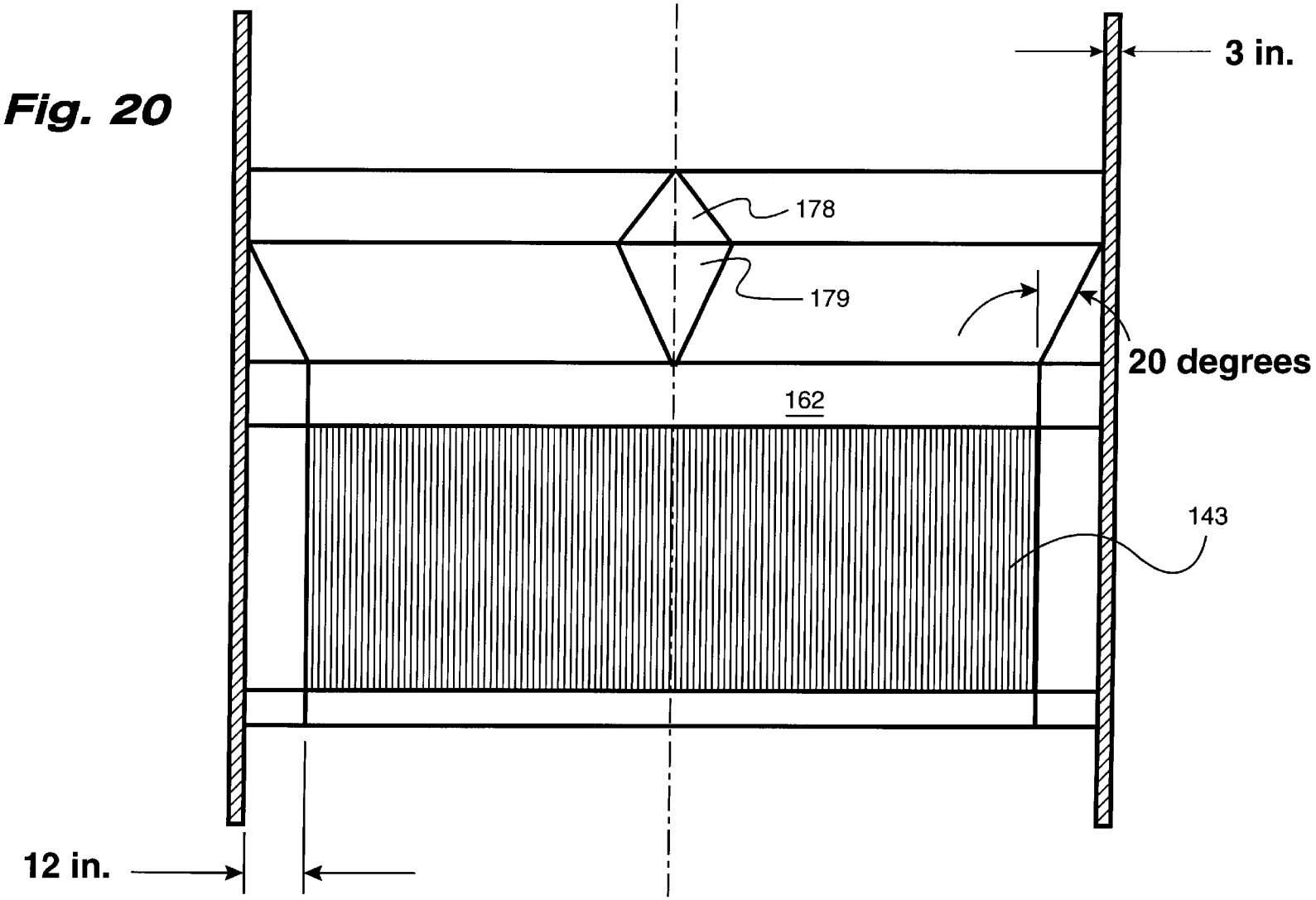
FIGS. 20 and 21 are cross-sectional views taken along lines 20—20 and 21—21 of FIG. 19, respectively.
Figure 21:
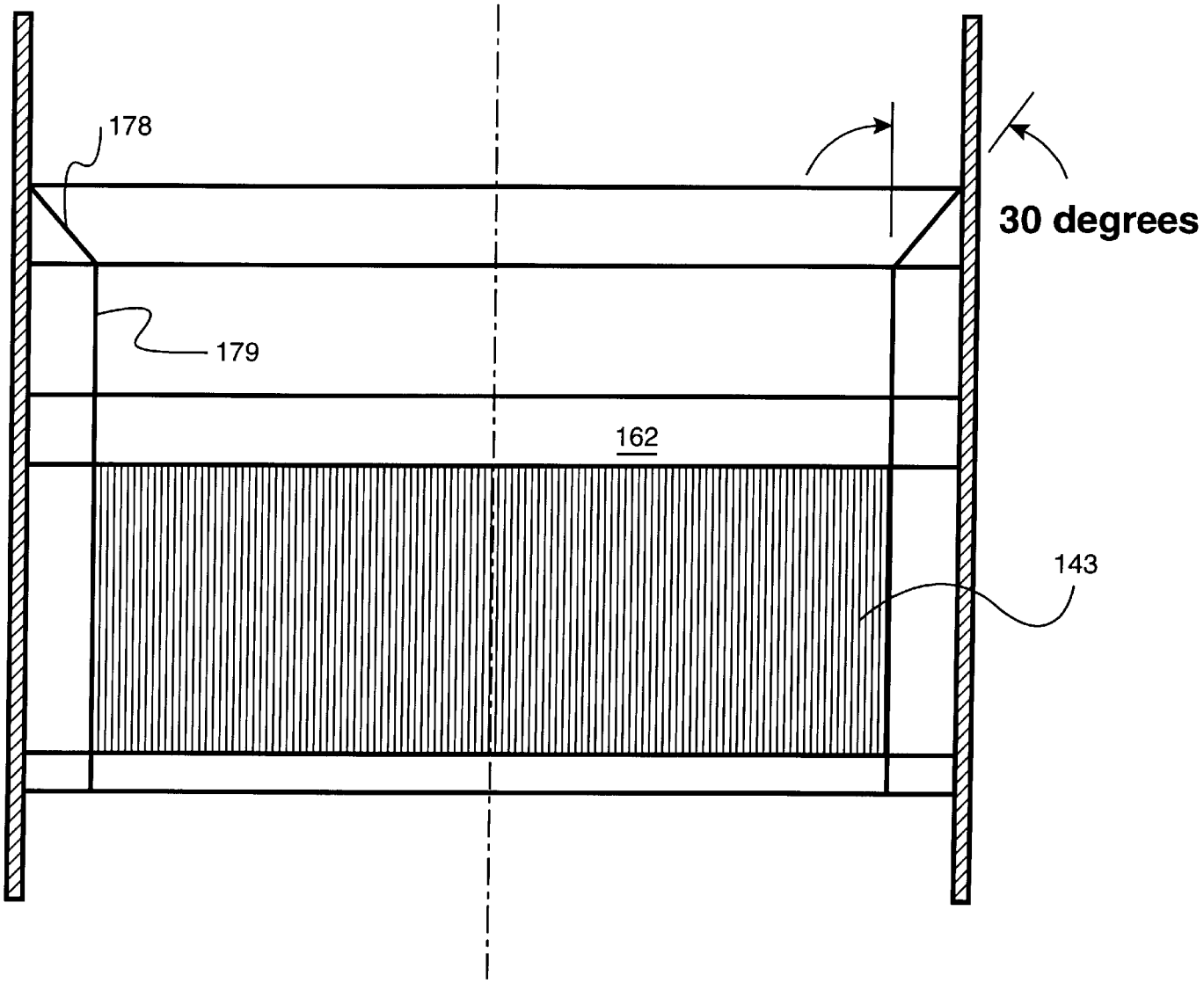

FIG. 19 illustrates a top view of a preferred embodiment of this invention. FIG. 20 shows a section view along the line 20—20 in FIG. 19. FIG. 21 shows a section view along line 21—21 in FIG. 19.

FIGS. 20 and 21 also include the preferred relief band 162, consisting of circumferential blank plate, located directly beneath the one-dimensional convergences. The preferred angles of convergence of the upper transition is shown in FIG. 21 as approximately 30 degrees. FIG. 20 shows a preferred angle of convergence of the lower transition of approximately 20 degrees. Though not illustrated in FIGS. 20 and 21, the screen plate 143 may also have a geometry that diverges, that is, the upper diameter of screen 143 may be smaller than its the lower diameter. This screen may have a angle of divergence from the vertical of from 0.5 to 10°, but typically it has an angle of divergence of about 1–5°, preferably, 1–3°.

Figure 22:
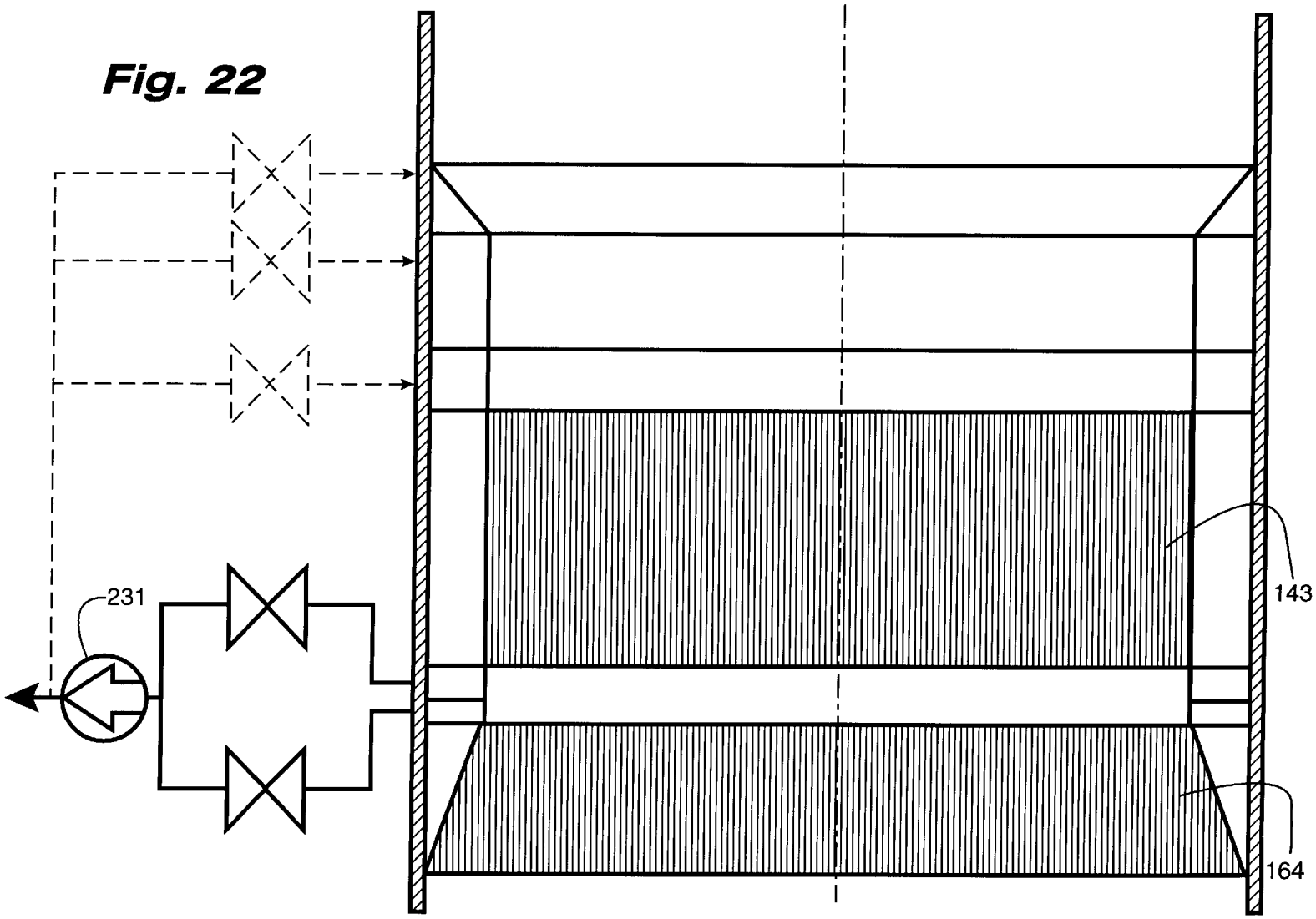
FIGS. 22 and 23 are views like those of FIG. 21, only showing different forms of screen configurations according to the invention.

FIG. 22 illustrates a modification to the system shown in FIG. 21. FIG. 22 includes a conical diverging screen section 164 located beneath the cylindrical screen 143, similar to what was shown in FIG. 7A. As shown in FIG. 22, a relief band may be positioned between the cylindrical screen and the conical screen. The liquid removed by means of screens 143 and 146 may enter a common cavity or separate cavities, for example, an internal or external header. As shown in FIG. 22, liquid removal from separate headers may be independently controlled by separate control valves which feed a common pump, 231, or separate pumps.

FIG. 22 also illustrates one additional embodiment of this invention in which dilution is introduced to one or more of the transition sections to aid in moving the chip slurry though each section. For example, dilution may be introduced to one of the single convergence transitions, preferably at the top of these transitions, or dilution can be introduced to a relief band. Dilution may be introduced by any form of conventional means, for example, through a plurality of orifices (for example, rounded or slotted orifices) or by means of a perforated plate or screen or by means of a weir. This dilution may take the form of any suitable liquid, for example, cooking liquor, spent cooking liquor, washer or bleach plant filtrate, preferably this liquor contains a low concentration of dissolved organic material. As shown in FIG. 22, one preferred source of dilution is the liquor removed via screen 143, or screen 164. In this case, after removal and pressurization in pump 231 some of the liquor is re-introduced via one or more conduits at one or more locations in the transition/screen assembly.

Figure 23:
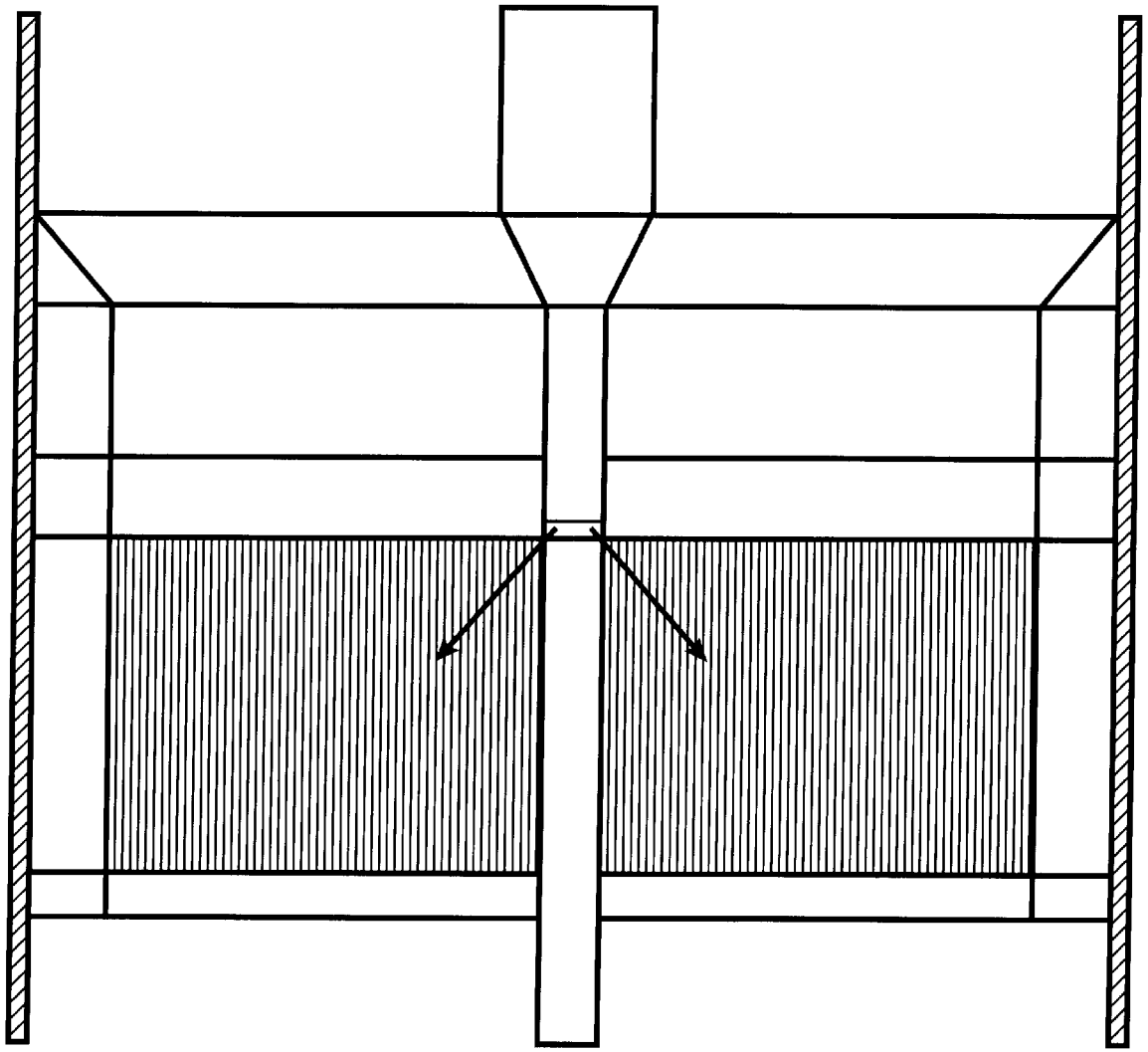

FIG. 23 illustrates a further embodiment of this invention. Typically, liquids are introduced to the chip column in the vicinity of screen assemblies by means of a pipe suspended from the top of the vessel. These "center-pipes" are typically used to introduce heated liquids containing cooking chemical, for example, kraft white liquor, to the chip column. Liquor and heat distribution is aided by the radial or axial movement of the liquid drawn by one or more screen assemblies. In this embodiment of the invention the geometry of the center-pipe is modified to mimic the geometry of the vessel transition. That is, in order to minimize the compaction of the chip column as the column encounters a converging transition, the geometry of the center-pipe also converges and relieves some of the radial compaction that would occur due to the vessel convergence having a non-converging center-pipe. This pipe convergence may simply be a conical convergence or the pipe geometry may exhibit single-convergence and side relief as discussed above with respect to the vessel transitions.

Of course, a center-pipe having convergent geometry—either conical or single-convergence and side relief—need not be restricted to use with a convergent screen assembly, but may be used solely for its own merits in any type of vessel. That is, a center-pipe having a convergent geometry can minimize the formation of voids and channels in a column of material. Such a center-pipe can be used in a vessel having a geometry that converges, for example, conically converges, to relieve compressive arching loads that may be created in the column of material being conveyed. Such a pipe can also be used in a non-convergent section to relieve vertical compaction loading in the material being conveyed.

While the invention is readily applicable to new constructions of digesters or other vessels for treating pulp or comminuted cellulosic fibrous material, the concepts of the invention may also be applied to existing digesters without requiring the digester diameter to be increased. For example with respect to the embodiment in FIG. 3, at a substantially constant first internal diameter 46 portion of the shell 113, at a location devoid of an agitator, the interior of the shell 113 is accessed while the digester 110 is empty, either by cutting an opening in the shell 113 which will ultimately be sealed up, or through an opening in the top portion thereof, the screen assembly 43 and transition 45 are introduced into the shell 113. The elements 43, 45 may be in pieces and assembled within the shell 113, and welded or otherwise connected together.

In the practice of this aspect of the invention, at the substantially constant internal first diameter portion of the shell 113 the screen assembly 43 is mounted to define a screen cavity 120 internal of the shell 113, and to provide a return to the diameter 46 below the screen assembly 43 (such as the step increase 127). Mounting may be by utilizing the structures 40 through 42, and 54, etc., just as for the new construction.

Either before or after the screen assembly 43 is mounted in place, at least one aperture—corresponding to the connection to the line 126 in FIG. 3—is provided in the shell 113 adjacent the screen cavity 120 such as communicating with the cavity 122 as illustrated in FIG. 3, to allow withdrawal of liquid in the screen cavity 120 that has been separated from the slurry by the screen assembly 43.

Then either before or after insertion of the screen assembly 43 (preferably after), the transition element 45 is mounted in place, as by welding, etc., to allow the slurry of comminuted cellulosic fibrous material to flow smoothly from above the transition element 45 to below the screen assembly 43 without bridging or hang-up, and without need for an agitator.

In the mounting of the screen assembly 43, a step increase 127 may be provided substantially immediately below the screen assembly 43, or one or both of the conical transitions 61, 63 and the relief plate 62 may be provided below the screen assembly 43 to provide return to the first internal diameter 46.

It will thus be seen that according to the present invention an advantageous digester, screen assembly, and method of treating a liquid slurry to produce chemical pulp, have been provided. The invention reduces the cost of manufacture of the shell of a digester by making external step increases in the digester shell unnecessary, and also minimizes channeling and enhances uniform treatment of the cellulosic material. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods. For example, It is to be understood that though the discussion above generally refers to the vessels in which the present invention can be used as digesters, this invention can be applied to any treatment vessel for treating comminuted cellulosic fibrous material that requires smooth flow through a converging transition. These include what are known in the art as impregnation or pretreatment vessels (which are part of digester systems), but can also be used in and washing and bleaching vessels.

What is claimed is:

1. A vessel for treating comminuted cellulosic fibrous material in a liquid slurry, the material having a critical angle of convergence; said vessel comprising:

a substantially vertical vessel shell having a first internal diameter;

a first screen assembly mounted at an agitator-free location in said vessel and for removing liquid from the slurry, and including a second internal diameter smaller than said first internal diameter, and defining a screen cavity internal of said shell;

a first transition above said first screen assembly, said first transition having an angle of convergence with respect to vertical and a diameter between the first and second diameters; and wherein said first transition angle of convergence is less than the critical angle of convergence of the liquid slurry cellulosic fibrous material, so that the slurry flows through the transition without bridging or hang-up, and without need for an agitator.

2. A vessel as recited in claim 1 further comprising another transition, located below said first screen assembly, having a diameter which increases from the second internal diameter to substantially the first internal diameter.

3. A vessel as recited in claim 2 wherein said another transition is substantially immediately below said first screen assembly.

4. A vessel as recited in claim 3 wherein said increase in diameter of said another transition comprises a step increase.

5. A vessel as recited in claim 3 further comprising: a second screen assembly having a third diameter and disposed below said first screen assembly at an agitator-free location in said vessel; and a second transition having an angle of convergence less than the critical angle of convergence of the liquid slurry cellulosic fibrous material and a diameter between said first and third diameters, so that the slurry flows through the transition without bridging or hang-up, and without need for an agitator.

6. A vessel as recited in claim 5 wherein said second transition has an increase in diameter which comprises a step increase in diameter to substantially said first internal diameter immediately below said second screen assembly.

7. A vessel as recited in claim 5 wherein said first and second transitions are both substantially right conical transitions, and wherein said first and second transition angles of convergence are both less than 40°.

8. A vessel as recited in claim 5 wherein said first transition comprises a substantially right conical transition, and wherein said first transition angle of convergence is about 10–25°.

9. A vessel as recited in claim 2 further comprising means for heating liquid withdrawn from said first screen assembly, and reintroducing heated liquid adjacent said first screen assembly.

10. A vessel as recited in claim 2 wherein said first transition comprises a substantially right conical transition, and wherein said first transition angle of convergence is about 10–25°.

11. A vessel as recited in claim 1 wherein said vessel comprises a continuous digester having a top and a bottom, with an inlet adjacent the top and outlet adjacent the bottom, and wherein said digester shell first diameter is substantially constant from just below said inlet to just above said outlet.

12. A vessel as recited in claim 1 wherein said first transition comprises a single non-symmetric one-dimensional convergence transition, including a triangular panel with a screen section of said screen assembly at least substantially immediately below said panel.

13. A vessel as recited in claim 1 wherein said first transition comprises a multiple symmetric one-dimensional convergence transition, including a pair of triangular panels with a screen section of said screen assembly at least substantially immediately below each of said panels.

14. A vessel as recited in claim 1 wherein said screen assembly comprises a discontinuous screen.

15. A vessel as recited in claim 1 wherein said first transition comprises multiple one-dimensional convergence transition elements.

16. A vessel as recited in claim 15 further comprising means for heating liquid withdrawn from said first screen assembly, and reintroducing heated liquid adjacent said first screen assembly.

17. A vessel as recited in claim 1 wherein said first transition comprises a plurality of eyebrow baffles.

18. A vessel as recited in claim 17 further comprising a screen section of said first screen assembly substantially immediately below each of said eyebrow baffles.

19. A vessel as recited in claim 18 wherein said first transition also includes at least one screen section.

20. A vessel as recited in claim 17 further comprising means for heating liquid withdrawn from said first screen assembly, and reintroducing heated liquid adjacent said first screen assembly.

21. A vessel as recited in claim 1 wherein said increase in diameter is spaced from said first screen assembly by at least one of a diverging conical transition and a cylindrical relief plate.

22. A vessel as recited in claim 1 wherein said first transition also includes at least one screen section.

* * * * *